United States Patent [19]

Miyachi et al.

[11] 4,114,544

[45] Sep. 19, 1978

[54] APPARATUS FOR FORMING LOOPS ON A GARMENT

[75] Inventors: Nobuji Miyachi, Kyoto; Akira Ogawa, Uji; Keniti Miyake; Isao Onishi, both of Kyoto, all of Japan

[73] Assignee: Miyachi Sewing Machine Co., Ltd., Kyoto, Japan

[21] Appl. No.: 786,141

[22] Filed: Apr. 11, 1977

[30] Foreign Application Priority Data

| | | | |
|---|---|---|---|
| Apr. 20, 1976 | [JP] | Japan | 51-45262 |
| May 20, 1976 | [JP] | Japan | 51-58815 |
| Aug. 3, 1976 | [JP] | Japan | 51-104136[U] |
| Nov. 19, 1976 | [JP] | Japan | 51-139897 |

[51] Int. Cl.[2] ..... D05B 3/12

[52] U.S. Cl. ..... 112/104; 112/121.27

[58] Field of Search ..... 112/104, 121.27, 121.26, 112/113, 120, 152, 147

[56] References Cited

U.S. PATENT DOCUMENTS

| | | | |
|---|---|---|---|
| 1,070,137 | 8/1913 | Jennings | 112/121.27 X |
| 3,699,907 | 10/1972 | Anderson et al. | 112/121.27 |
| 3,792,672 | 2/1974 | Friedman et al. | 112/104 |
| 3,841,247 | 10/1974 | Off et al. | 112/104 |
| 4,046,088 | 9/1977 | Asel et al. | 112/121.27 X |

*Primary Examiner*—H. Hampton Hunter

[57] ABSTRACT

Elongated piece of material being delivered sequentially to cut in a predetermined length and the cut piece is folded at its opposite ends. The folded piece is delivered to the sewing machine which is placed transversely and is sewn to the garment. One of the folded ends is followed by the other folded end in being sewn to the garment. The apparatus of the present invention carries out the above procedures full-automatically.

10 Claims, 28 Drawing Figures

187
M
187

152
152b
152c
173a
189
187
173
171
186
158
159
188
172
174
176
175
184
183
179
183
190
170
191
185

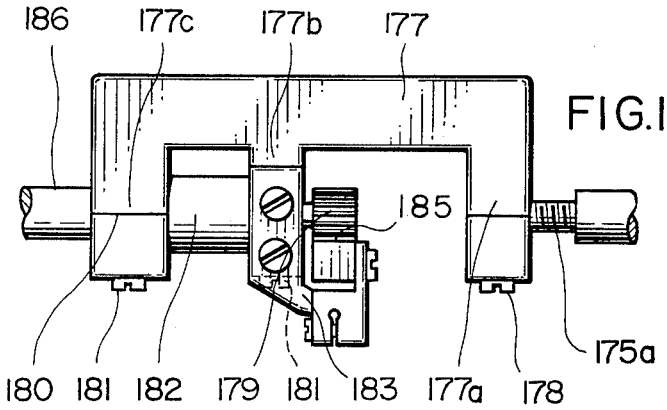
FIG.12
FIG.13
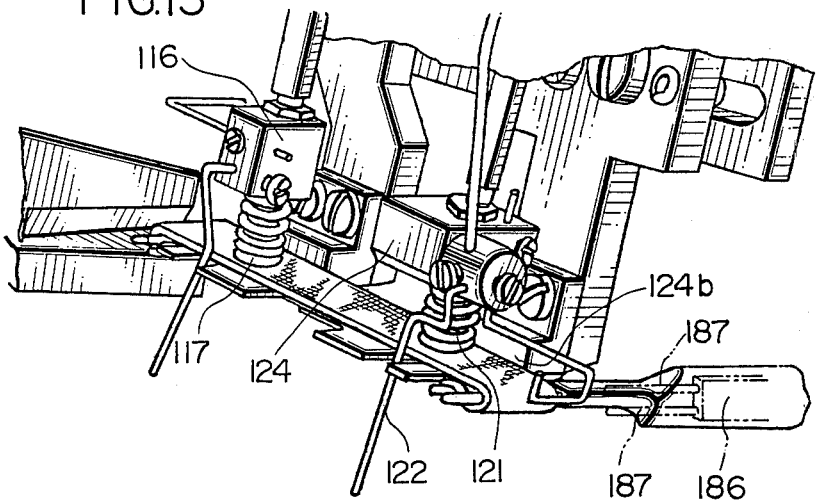

APPARATUS FOR FORMING LOOPS ON A GARMENT

The present invention relates to a belt looper apparatus, and more particularly to an apparatus for forming loops having two folded ends on both sides of cut pieces and for sewing them to the garment.

In the manufacture of various articles of clothing, for example pants, dungarees and jeans, a number of belt loops must be sewn to the garment. Generally, this operation is performed manually. Usually, two folded over ends of a cut piece of certain length are placed on the desired part of the garment and then are stitched to it by the sewing machine. These operations if performed manually require much labor, rendering the garment costly to make.

In consideration of these problems, an apparatus for automatically forming and stitching the loops is developed as disclosed in the specification of U.S. Pat. No. 3,699,907. According to this apparatus, a certain length of a cut piece is carried to the loop transfer head by the carriage where the folding and gripping jaws fixed thereto perform folding and gripping. Then the jaws advance to the direction of the sewing machine and delivers the folded piece to the clamp assembly provided between the position where said head receives the cut piece and the sewing machine. The clamp assembly after receiving the folded piece advances to the direction of the sewing machine by which the folded piece is stitched to the garment.

As is obvious from above descriptions, an apparatus according to the U.S. Patent performs four main steps. First, a step to send the cut piece to the loop transfer head by the carriage thereby allowing said head to receive the cut piece. Then, a step to fold the cut piece by the head and to deliver the folded piece to the clamp assembly. Then, a step where the clamp assembly after receiving the folded piece advances to the direction of the sewing machine so as to engage in stitching work. And finally, a sewing step by means of the sewing machine.

Generally as the number of the steps increases, the overall operation requires an increased time and a more complicated mechanism. In the present invention, the carriage as a carrying mechanism for the cut piece is omitted and an apparatus for carrying out folding and clamping of the cut piece with the same mechanism is provided for the purpose of structural simplification and speeding-up of the work.

Another object of the present invention is to provide an apparatus which is provided with a mechanism for leading the elongated piece of material precisely to the place of folding where the material being stabilized so as not to allow the movement of the cut piece during the folding.

Still another object of the present invention is to provide an apparatus in which the length of the cut piece can be optionally controlled thereby enabling a free adjustment of the length of the belt loop to be sewn to the garment.

Still another object of the present invention is to provide an apparatus which is arranged to prevent the hitting of fingers which clamp the folded ends against the hand of the operator who is standing by and supporting the garment by the fixing part of the sewing machine by means of orbiting said fingers curvilineary while it is transferred to the sewing machine.

Still another object of the present invention is to provide an apparatus in which the presser plate can be movably fixed and two presser foots separately fastening both ends of the folded piece are also movably mounted and after one end of the piece is sewn, said presser plate and presser foots are shifted and the other end of the piece is guided to the position of the needle so as to be sewn.

Still another object of the present invention is to provide an apparatus which is arranged so that it detects the seam portion of the elongated piece and eliminates that portion.

Still another object of the present invention is to provide an apparatus in which a space is provided between the folded piece and the garment during the sewing of the piece in order to facilitate the passage of belts of large thickness.

Further objects and advantages of the present invention will become more apparent from the following detailed descriptions upon reference to the attached drawings.

FIG. 12 is a front view of a connector block for the clamp means;

FIG. 13 is a fragmentary perspective view showing the fastening means with a cut material thereby clamped at its opposite ends;

Figure 2:
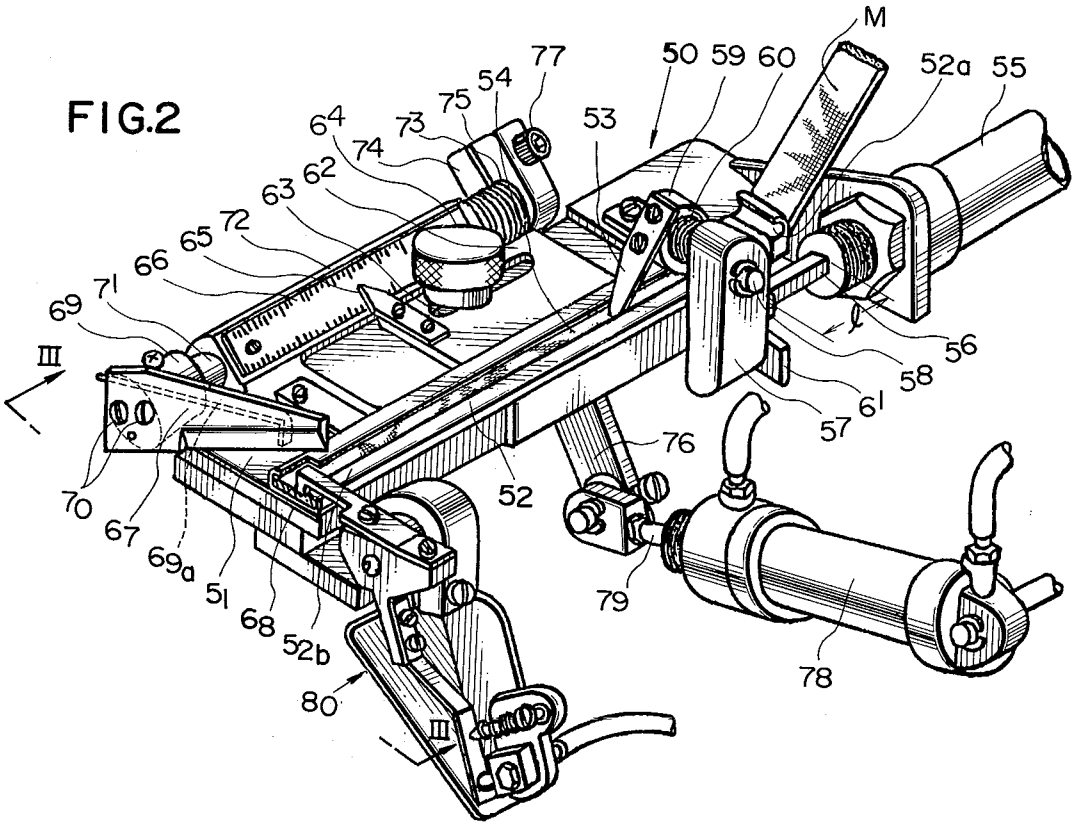
FIG. 2 is a perspective view of delivery means.

A delivery means 50, as shown in FIG. 2, guides in elongated material M from one end 52*a* of a trough 52 mounted above a plate 51 with certain inbetween space and having a substantially C-shaped cross-section, and delivers said material M through the other end 52*b* with the working of a delivery pawl 53. The inlet end 52*a* of the trough 52 is widened toward the end so as to facilitate the introduction of the material M, while the cross-sectional shape of the trough is adapted to prevent the sideward and vertical movements of the material M therein and to smoothly feed out the material M. Said delivery pawl 53 is inserted to an opening 54 at the upper part of the trough 52. This delivery pawl 53 is drawn back and forward by an air cylinder 55. The delivery pawl 53 must precisely move back and forward without any sideward movement in the opening 54. For this purpose, as is illustrated, the rod 56 of the air cylinder 55 is preferred to have a rectangular shape by which the twisting movement can be avoided. As a cylinder having a rectangular rod, Martonair's MC-C Type can be used. A holder 57 is fastened on top of the rod 56 of the air cylinder 55, and the delivery pawl 53 is pivotally mounted on the holder 57 cantileveringly through a shaft 58 and a bracket 59. A coil spring 60 gives the delivery pawl 53 a constant downward counterclockwise pivoting power. As the result of this pivoting action, the delivery pawl 53 thrusts into the material M to ensure the sending of the material when it takes the position shown in FIG. 2, and after finishing the feed-out of the material the delivery pawl 53 retreats sliding the surface of the material M. A rear end of the holder 57 contacts a stopper 61 in order to limit the drawing back of the holder, and due to this fact the withdrawal length of the delivery pawl 53 is limited thereby enabling the adjustment of the delivery length per once, namely the stroke L of the air cylinder 55 minus withdrawal-prohibiting length l (L−l). The stopper 61 is projecting from a supporting member 62 having an L-shaped cross-section. This supporting member 62 is located in a space between the supporting plate 51 and the trough 52, and an elongated bore 63 and a fastening knob 64 are adapted to allow the stopper 61 to move on and fix to the plate 51. Numeral 65 designates an indicating pointer which indicates scales on a scale plate 66. Feeding amount of the material for one time is measured by this scale.

A cutter 67 in cooperation with an edge 68 provided at an end of the supporting plate 51 cuts the material M. The cutter 67 is secured to an end of a boss 69 with screws 70, and said boss 69 is secured to a shaft 71. A plate spring 69*a* with its tip folded downwards is fastened to the boss 69 which is pivoted thereby pivoting the cutter 67 and simultaneously the plate spring 69*a* pressing the material M with its folded tip. Thus, the delivery pawl 53 is drawn back to its original position while the material is pressed by the plate spring. Therefore, the material once fed is not drawn back by the return stroke of the delivery pawl 53 which singly retreats to its original position sliding the surface of the material. The shaft 71 is rotatably supported in a sleeve 72 provided at the supporting plate 51 and receives an axial force due to a spring 73. Owing to this spring force, the contact pressure between the cutter 67 and the edge 68 is controlled. On the other end of the shaft 71, a jaw 74 and a jaw 75 provided on one end of a crank lever 76 are tightenedly secured with a bolt 77. When the bolt 77 is loosened and the jaws 74, 75 are pressed toward the cutter 67 while holding the side of the cutter 67, the spring 73 is compressed thereby raising the contact pressure of the cutter 67 and the edge 68. A rod 79 of a pivoting air cylinder 78 is pinned on the lower end of the crank lever 76. The material is cut by the backward and forward movement of the rod 79 which accordingly pivots the cutter 67. Part of the sleeve 72 is flat where said scale plate 66 is fixed. Representations on the scale 66 shows said value of (L−l).

Figure 3:
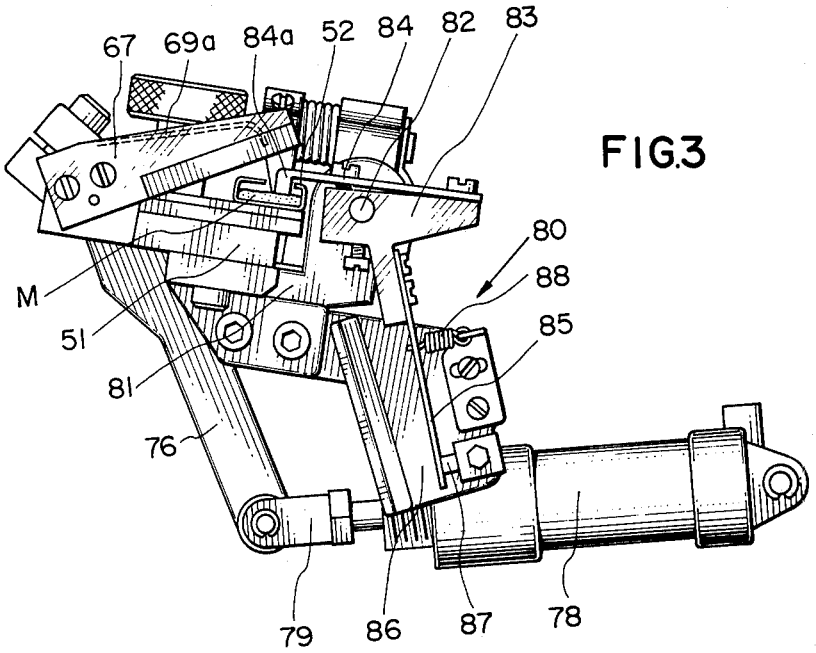
FIG. 3 is a view of the same as seen in the direction of the line 3—3 in FIG. 2, the view showing seam detecting means and a cutter.
Figure 3A:
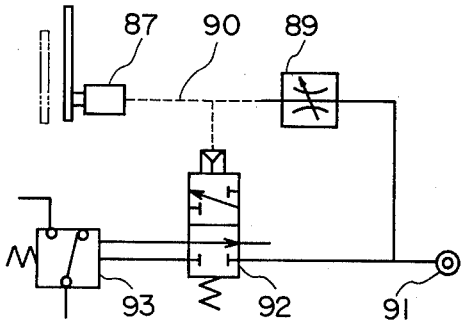
FIG. 3A is a diagram showing an example of the control circuit to be operated by the seam detecting means.

On the periphery of the outlet end of the trough 52, a detecting means 80 for the seam portion of the material is provided. The material M is preliminarily prepared as a belt-shaped one connected in series, which therefore has seam portions without fail. If a cut piece of certain length having a seam portion therein is delivered to the sewing machine similarly to the normal cut piece, and is sewn to the garment, the produced garment looks less attractive. Therefore, this seam portion must be eliminated. As is shown in FIGS. 2 and 3, a bracket 81 is supported by said supporting plate 51, and an enlarging lever 83 is pivotally mounted on a pin 82 of the bracket 81. This lever 83 is substantially T-shaped and is provided with a detecting plate 84 on its upper side portion and a valve-opening plate 85 on its lower side portion. The valve-opening plate 85 opens and closes an air valve 87 fastened to a member 86 which is fixed to said bracket 81. When a bent end 84*a* of the detecting plate 84 runs on to the seam portion, the enlarging lever 83 is pivoted clockwise to form a space between the valve 87 and the plate 85 parting one from the other. Numeral 88 designates a spring which is provided for tensing the plate 85 always to the direction of the valve 87 thereby keeping a contact between the plate and the valve. As is shown in FIG. 3A, an air source 91 is connected to the valve 87 through a throttle valve 89 and a pipe 90. The pressure applied to the inside of the pipe 90 when this valve is closed lowers due to the opening of the valve and as a result a switch valve 92 is switched over thereby changing the contact point of a pressure switch 93 to give a signal. The eliminating work of the seam portion is carried out by this signal, to be detailed hereinafter.

Figure 4:
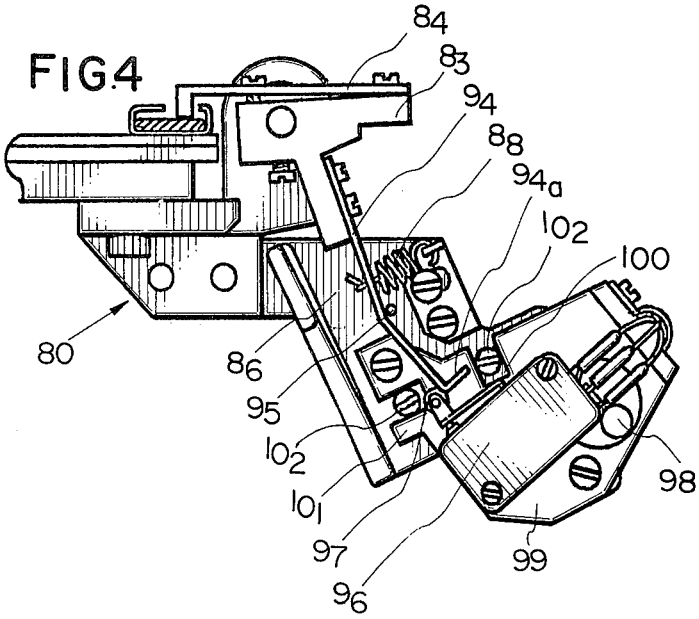
FIG. 4 is a view similar to FIG. 3 and showing another example of the seam detecting means.

FIG. 4 shows another embodiment of the detecting means for the seam portion, having different procedures in reading out the signal. Similarly to the aforementioned embodiment, a lever 83 is provided with a detecting plate 84 and a plate 94 respectively and the plate 94 is arranged to be tensed to one direction, namely counterclockwise, by the action of a spring 88, while pivoting of the plate 94 is prevented by a stopper 95. A detecting switch 96 is fixed to the lower portion of a member 86 and an actuating roller 97 of the switch 96 is provided so that it contacts a bent lower end 94*a* of said swing plate 94. A luminescent diode 98 connected to terminals of the detecting switch 96 represents the detection of the seam. Numeral 99 designates a mounting plate for the detecting switch fastened at the lower portion of a fastening member 86. An elongated groove 100, and an elongated groove 101 having different direction to each other are formed on the mounting plate 99 and the mounting plate 99 are movable in vertical and sideward directions in accordance with the pivoting movement of guide shafts 102, 102 pivotally provided at the lower portion of the fastening plate 86 thereby enabling fine adjustment of the relative position between the bent end portion 94*a* of the swing plate 94 and the actuating roller 97 of the detecting switch 96. After the adjustment of the timing for putting on the detecting switch 96, said mounting plate 99 can be fixed at a proper position by using screws.

Figure 1:
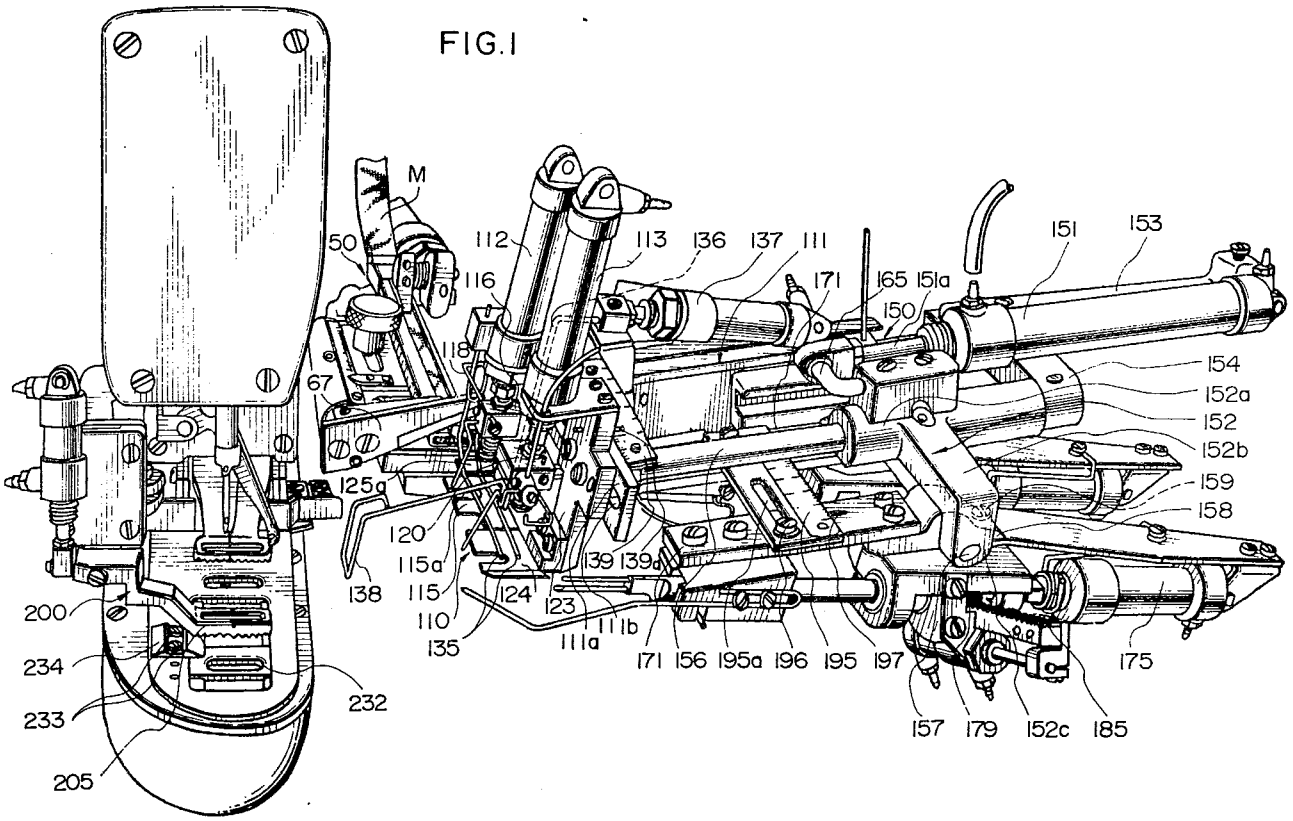
FIG. 1 is a perspective view of an apparatus of this invention.

The material M delivered by the delivery means 50 is fastened by a fastening means 110 then is cut by the cutter 67. As is shown in FIG. 1, the fastening means 110 is fixed to a front end 111*a* of a supporting member 111 having an L-shaped plane. This supporting member 111 and said supporting plate 51 are fastened on the same base, although the illustration is omitted, thereby providing an ever same relative position between the delivery means 50 and the fastening means 110. In relation to the front end 111*a* of the supporting member 111, an air cylinder 112, 113 respectively is arranged in parallel and the cylinder 113 is movably and fastenably fixed to the front end 111*a* by using the elongated bore 111*b*.

Figure 5:
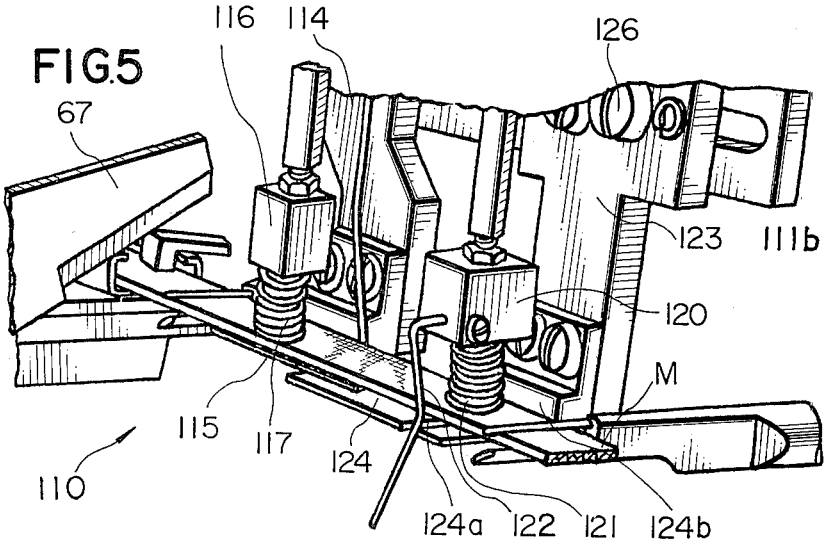
FIG. 5 is a fragmentary perspective view of fixing means.

A receiving plate 115 is mounted to the lower end of a supporting plate 114 supporting the cylinder 112. This receiving plate 115 has a cutout portion 115*a*. At the center of the lower end of a block 116 fixed to the lower end of the rod of the cylinder 112, provided is a spring 117 by which the material fed onto the receiving plate 115 is pressed on the receiving plate. Numeral 118 designates an arm provided for the purpose of pressing the material M fed onto the receiving plate 115 to the inner direction. The arm is guided into said cutout portion 115*a* to press the side of the material M. Unlike an arm 122 provided on the side of a block 120 fixed to the lower end of a rod of the movable cylinder 113, this arm 118 is not necessarily required. Therefore, if the arm 118 is not provided, the cutout portion 115*a* is not needed either. As shown in FIG. 5, the cylinder 113 is fixed to a supporting plate 123 and the block 120 is provided at the lower end of the rod. A spring 121 is mounted at the center of the lower end of the block 120, and, the arm 122 is provided in the front thereof. At the lower end of the supporting plate 123 provided is a receiving plate 124 having a cutout portion 124*a* wherein said arm 122 is inserted through. The arm 122 has a substantially perpendicular portion and a portion outwardly widened. When the block 120 is ascending, the widened portion takes the position above the 124*a* slipping therethrough thereby leaving a large interval from a vertical wall 124*b* located on the inner side of the receiving plate 124. Owing to this fact, the material M can easily be delivered onto the receiving plate. However, when the material M is fed in certain length, the block 120 starts to descend by the action of the cylinder 113 thereby lowering the arm 122 too. So the vertical portion of the arm 122 comes into the cutout portion 124*a* thereby providing an interval between the arm and the vertical wall 124*b* having substantially the same length with the width of the material M. The hem of the material is pressed to the vertical wall 124*b* by this arm. Thus, by pressing the hem of the material against the vertical wall, the folded piece having a completely folded portion with no discrepancies can be formed, the details of which will be shown hereinafter. As the supporting plate 123 is fastened to said elongated bore 111*b* by means of a bolt and a nut 126, the plate 123 is horizontally movable when said nut is loosened. Said receiving plates 115 and 124 are formed so that one overlaps the other, so the receiving plate 124 moves according to the movement of the supporting plate 123 accompanying no trouble. As mentioned above, the cylinder 112 located near the cutter 67 is fastened motionless while the cylinder 113 is movably formed for the purpose of keeping a constant folded portion of the cut piece by means of shifting the cylinder 113 in the case cut pieces have different lengths. When said rectangular type rod is used for each said cylinder 112, 113, it is preferable for preventing the rotation of the blocks 116, 120 and accordingly for pressing the material always at a constant position maintaining a constant relative position between the arm 122 and the material.

Figure 7:
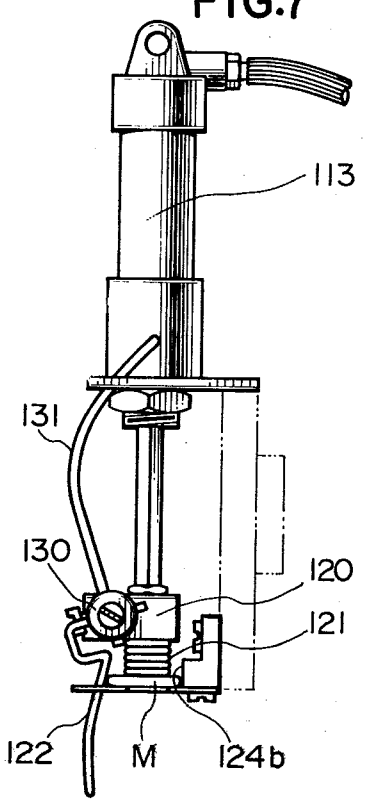
FIG. 7 is a side elevation of FIG. 6.
Figure 6:
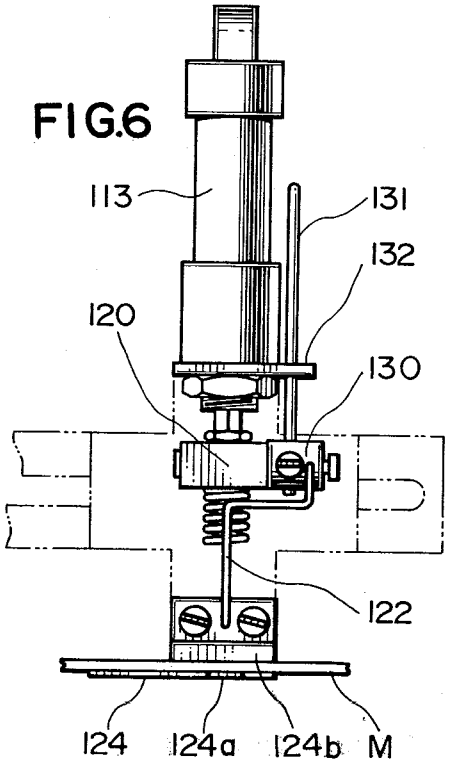
FIG. 6 is a front view showing another example of the mechanism for restraining the edge of material.

Shown in FIG. 6 and FIG. 7 are embodiments wherein the movable cylinder 113 is provided with a means for pivoting the arm. A block 130 is pivotally mounted against the block 120 and the arm 122 is fixed to the block 130. From the block 130, a regulating rod 131 is upwardly provided and the rod 131 is then curved backwardly. As the rod 131 is so mounted that it is inserted through the bore of the guide plate 132, as the block 120 descends the rod 131 is regulated by the bore of the guide plate 132 thereby pivoting the block 130 around the horizontal axis and the arm 122 in the cutout portion 124*a*, applying pressure to the hem of the material M from the side portion thereof. Through these mechanism, the material M is securely pressed against the vertical wall 124*b*. As is shown in FIG. 3, if the trough 52 is slanted, the material sent out of the trough slides toward the direction of the vertical wall 124*b* on the receiving plates 115, 124 and the hem of the material contacts the vertical wall 124*b*. This, however, does not guarantee a secured contact. In order to satisfy this requirement, the arm 122 and if necessary the arm 118 too are arranged to lead the inner hem of the material in contact with the vertical wall 124*b*.

Numeral 135 in FIG. 1 designates guide bars which prevents upward bending of the fed material guiding it substantially horizontally. An interval having a length about two times as large as the thickness of the material is provided between receiving plate and the guide bars. An interval between the guide bars is to arranged that it does not hinder the pressing movement of the springs 117, and 121 fixed at the lower end of each block 116, 120 against the material when said blocks 116, 120 descend. Numeral 135*a* designates a guide bar extended downwardly from the block 116. The guide bar 135a prevents downward bending of the material fed onto the receiving plates 115, 124. Although this guide bar descends with the block 116, the block 116 descends after the material is fed onto the receiving plate and so there is no problem. Numeral 136 in FIG. 1 designates an L-shaped rod which moves backward and forward by the air cylinder 137. The bottom end of this rod repels the cut piece having a seam portion from the receiving plate. The cylinder 137 is actuated by a signal from said detecting means for the seam portion and repels the cut piece having a seam portion and then a member 138 receives the repelled cut piece preventing further sending of the cut piece toward the sewing machine. Numeral 139 designates a scale plate fastened to the fore end 111*a* of the member 111. The scale plate indicates the position of the sliding cylinder 113. Numeral 139*a* is a pointer.

Figure 8:
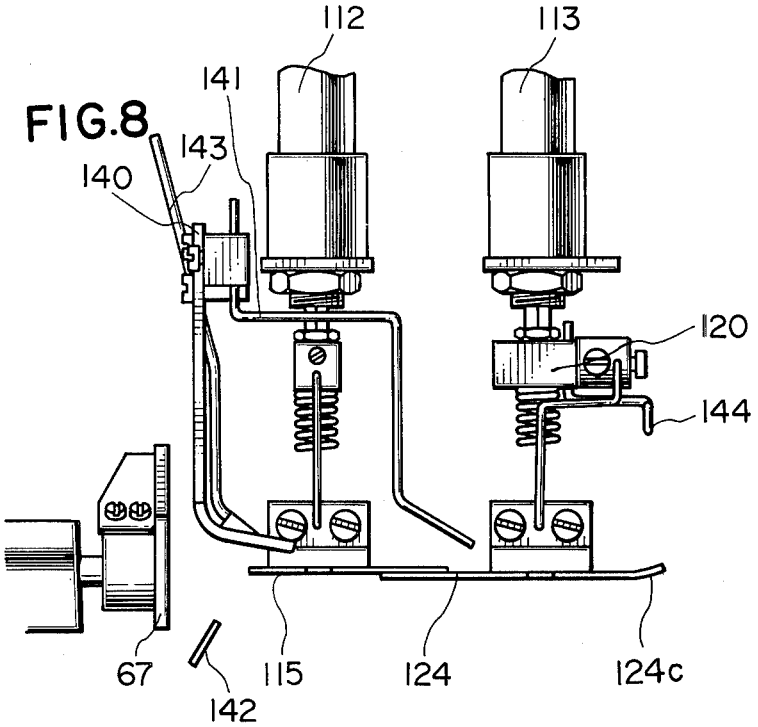
FIG. 8 is a fragmentary view showing another example of the fastening means.

Another embodiment of the guide means for guiding the material horizontally is shown in FIG. 8. A guide 140 and a guide bar 141 suitably fastened to said member 111 are positioned at the upper portion of the receiving plate 115, 124 and further an air blow nozzle 142 is provided at a position lower than the receiving plate 115 between the receiving plate 115 and the cutter 67. The fore end portion of the material is upturned by the air blown by the nozzle 142 and is guided onto the receiving plate 115 without fail, while an extreme upturning of the material is adjusted by the guide 140 and the guide bar 141. Numeral 143 is an air nozzle which blows out air jets at the signal from said detecting means for the seam portion and repels the cut piece in the same direction in which the material is fed. In aforementioned example, the cut piece is repelled transversely, namely to the direction of the sewing machine, while in this embodiment the cut piece having a seam portion is repelled to the same direction as that of the feeding of the material thereby preventing such an accident that the repelled cut piece is sewn by the sewing machine. In this embodiment, a regulating rod 144 is projecting from the block 120, while a curved portion 124*c* is upturnedly provided at the end of the receiving plate 124. The portion of the material that comes off the receiving plate 124 is inclined to bend downwards due to its gravity. Especially, if the material M is thin or frail this tendency is still greater. In order to prevent this tendency, the portion that comes off the receiving plate 124 is forcibly upturned by the upturned curved portion 124c and the extremely upturned portion is pressed back contrarily downwards by the rod 144 when the block 120 comes down thereby putting the material horizontally.

Figure 9:
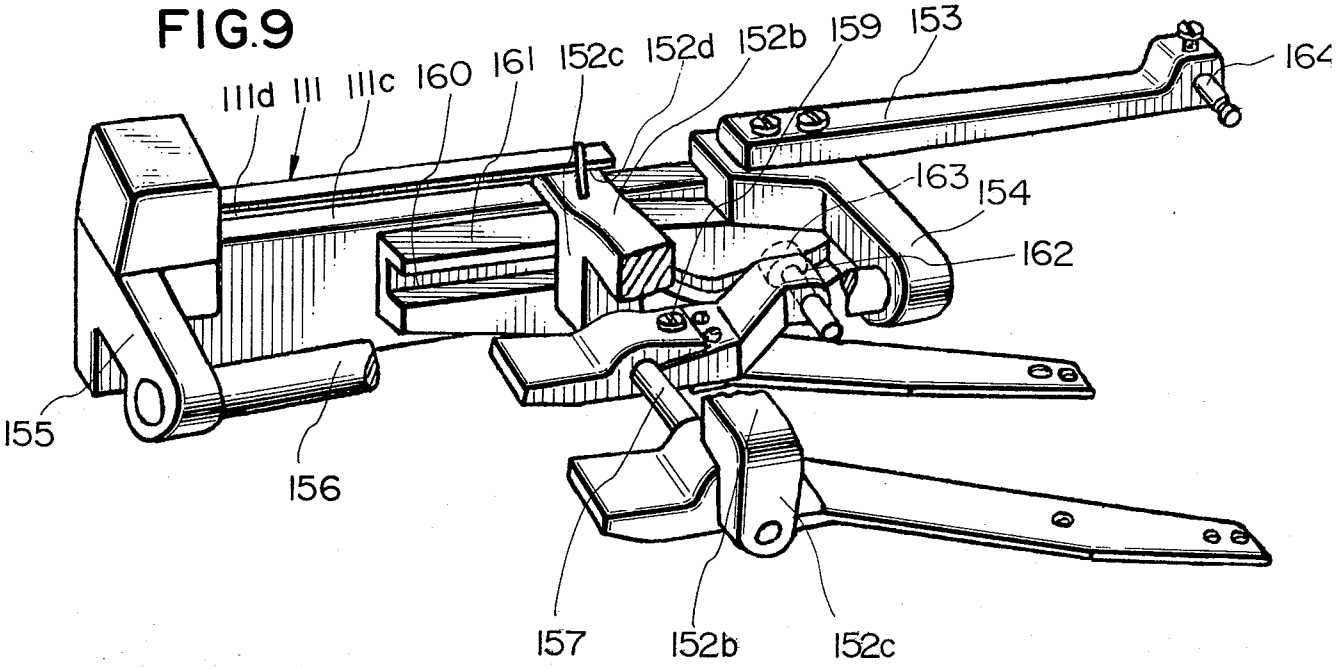
FIG. 9 is a perspective view partly broken away to show a movable bracket included in transfer means and as mounted in place.

A transfer means 150 gives a movable bracket 152 to-and-fro movement by means of an air cylinder 151, and delivers two clamp means which are fixed to the movable bracket and which sends two clamp means to the direction of the sewing machine, and then contrarily sends back two clamp means from the position of the sewing machine to their original place. As is shown in FIG. 1 and FIG. 9, a cylinder supporting member 153 is projecting from the side portion 111*c* of the supporting member 111 while brackets 154, 155 are projecting transversely and a rod 156 is fastened horizontally to these brackets. The movable bracket 152 is slidably fixed to the rod 156 to deliver two clamp means to the direction of the material M, therefore the rod 156 is located at right angles to the feeding direction of the material M. A cylindrical sliding portion 152*a* which slides on the rod 156 and an arm 152*b* extended to the right and left directions perpendicular to this sliding portion 152*a* are provided to the movable bracket 152. A shaft 157 is rotatably mounted to bearings 152*c*, 152*c* extended downwards from both ends of the arm 152i b, and two cylinder supporting members 158, 158 are fastened to the shaft 157 each on its right and left by the screw 159. In the inside of the side portion 111*c* of the member 111, a member 161 having a grooved cam 160 is fixed, and as is shown in FIG. 9, a roller 163 mounted to an arm 162 extending rearwards from the inside supporting member 158 is engaged therewith and the shaft 157 is slightly rotated in accordance with the sliding movement of the movable bracket 152 thereby oscillating the supporting members 158, 158. Further, a slider 152*d* is projecting from the inside end of the arm of the movable bracket 152, and the slider 152*d* is fitted in a recess 111d located at the upper end of the side portion 111*c* facing transversely and slides thereby preventing the rotating of the movable bracket 152 around the rod 156. The rear end of the cylinder 151 is pivotally mounted on a pin 164 of the cylinder holder 153 and a coupling member 165 is projecting from the rod 151*a* of the cylinder 151 thereby coupling the sliding bracket 152 thereto.

Figures 11, 14:
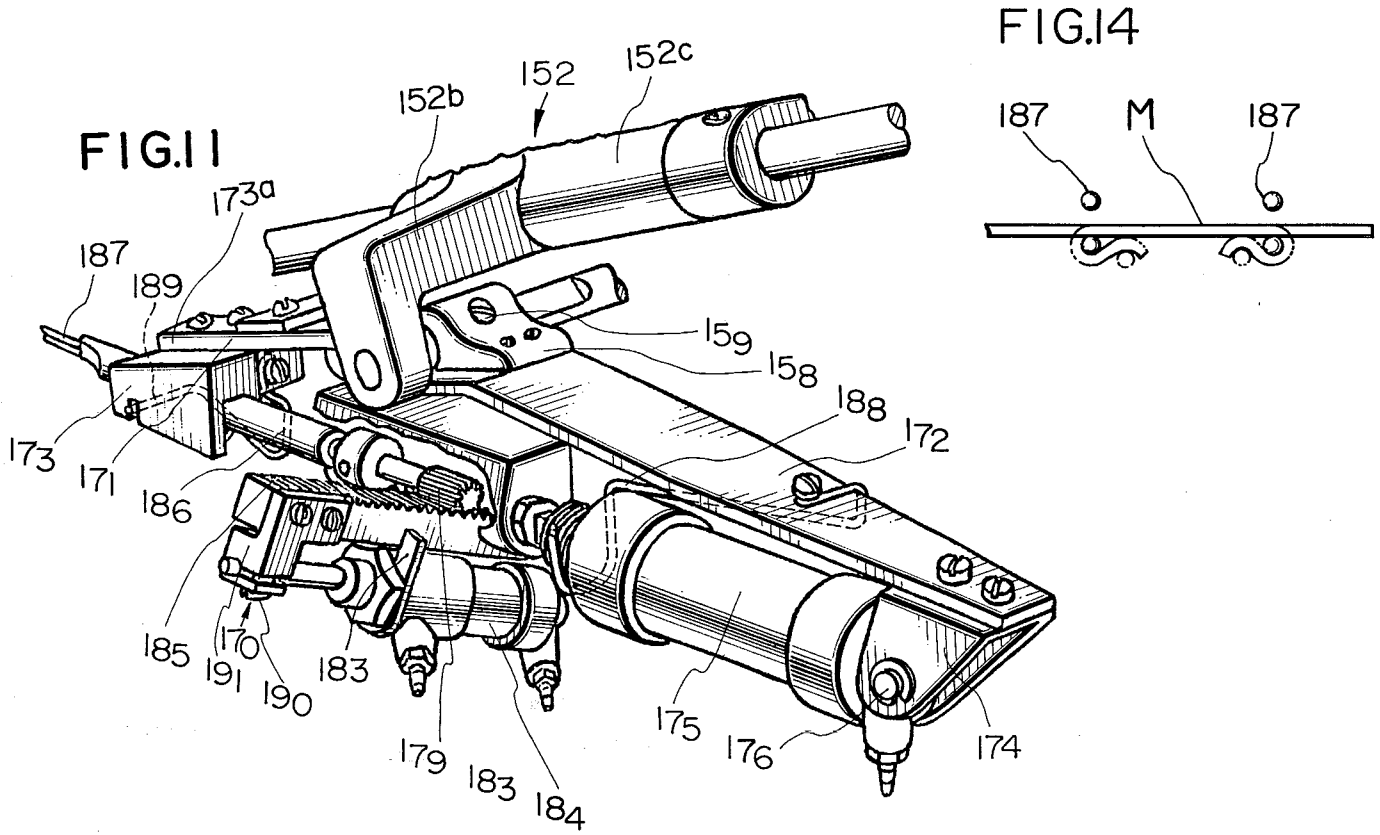
FIG. 11 is a perspective view of clamp means.
FIG. 14 is a view illustrating the cut piece as clamped at its opposite ends.

Each set of clamp means 170 is meant to be provided respectively to two holders 158 fastened to the shaft 157, both sets having substantially the same constructions. One shown in FIG. 11 is to be provided on the left side while one to be on the right side is symmetrical thereto.

Descriptions will be made as to the left one hereunder. Plates 171, 172 are fastened to the fore portion and the rear portion of the holder 158 respectively by using the screws, the fore plate 171 being provided with a guide block 173 and the rear plate 172 being provided with a bracket 174. The rear end of an air cylinder 175 is pivotally mounted on the bracket 174 by a pin 176 and a rod 175*a* of the air cylinder 175 is connected to a rear end portion 177*a* of a coupled block 177 as is shown in FIG. 12. The coupled block 177 has a substantially E-shaped front, being integrally formed by coupling the rear end portion 177*a*, a middle portion 177*b*, and a fore end portion 177*c*. The rear end portion 177*a* is divided into two members to which screws are fastened with the tip portion of the rod 175*a* therebetween. The middle portion 177*b* and the front end portion 177*c* are provided with bores at their centers so as to pass a pinion 179 therethrough thereby forming a bearing portion. A slot 180 is provided on a part of the bearing portion for facilitating the fastening of the bearing. A screw 181 is adapted to prevent the disengagement of the bearing. A sleeve 182 which prevents the pinion 179 coming out is inserted between the middle portion 177*b* and the fore end portion 177*c* and is fastened to a shaft 186 by a screw (not shown). The pinion 179 is inserted from the side of the fore end portion thereby fastening the bearing by the screw 181 and the sleeve 182 by the screw when the pinion reaches the prescribed position. From the middle portion 177*b* a holding plate 183 is projecting and an air cylinder 184 is suspended on the holding plate thereby interlocking a rack 185 which is actuated by the air cylinder 184 with said pinion 179. The pinion 179 is coupled to the shaft 186 extended forwardly through a groove 173*a* provided on the guide block 173 which is mounted on the fore plate 171, and fingers 187, 187 for clamping one of the folded ends are mounted on top of the shaft 186. The air cylinder 175 is supported by a spring 188 fastened to the rear plate 172, and the shaft 186 is supported by a spring 189 at the portion of the block 173. These mechanism enable a vertical pivoting of fingers 187, 187 around the pin 176. Usually, the fingers are upwardly tensed by the action of springs 188, 189. Thus, the fingers are pivotally formed for the purpose of enabling pressing of the folded end against the garment together with the fingers when the fingers advance to the position of the sewing machine in order to sew the folded piece to the garment, details will be mentioned hereinafter. After the fingers are pressed against the garment and pulled back rearwards by the transfer means, they return to the upper side by the action of the springs 188, 189. For carrying out these actions, one of the springs 188, 189 will be enough.

Fingers 187, 187 are projecting forwardly in parallel from a flat tip portion 186*a* of the shaft 186, and an appropriate interval, for example two times as long as the width of the material, is provided between the two fingers. As is shown in FIG. 13, the tips of the fingers are located at approximately the same position as the vertical wall 124*b* of the receiving plate when they retreat to their utmost positions to allow the material placed between them. As is shown by the imaginary line, both fingers are taking substantially vertical relative positions, namely, one is located above the other and the lower finger is one the same level with the under surface of the receiving plate 124. Said pinion 179 and said rack 185 are adjusted so that two fingers are substantially vertical when the rack 185 projects outwards at its maximum, namely when the rod of the air cylinder 184 projects to the utmost extent. As is shown in FIG. 11, the rack 185 and the rod of the air cylinder 184 are coupled through a screw 190 and a block 191. When the rod is arranged to move back and forward against the block 191 by loosing the screw 190, it is easy to make fine adjustment of the location of the fingers in relation to the projecting length of the rod. As is shown in FIG. 14, a pair of fingers 187 arranged on the right and the left sides of the receiving plates is placed so that one comes above the other. This position is kept during the advancement and the portion of the material M is inserted between the upper and the lower fingers. Then, after the material being cut, the fingers are rotated by said rack 185 and said pinion 179. The upper finger rotates to the position of the imaginary line shown in the figure and the lower finger rotates at the position substantially the same, thus folding the end portion of the cut piece. In this case, the fingers must be rotated about 270° and so the interlocking length of said rack 185 with pinion 179 and the stroke of the air cylinder 184 must be chosen. In consideration to said actions of the fingers, the air cylinder 175 having a rectangular type rod is used.

Figure 10:
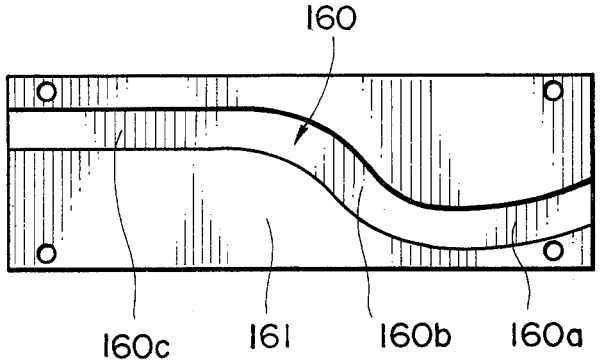
FIG. 10 is a front view of a grooved cam.
Figure 15:
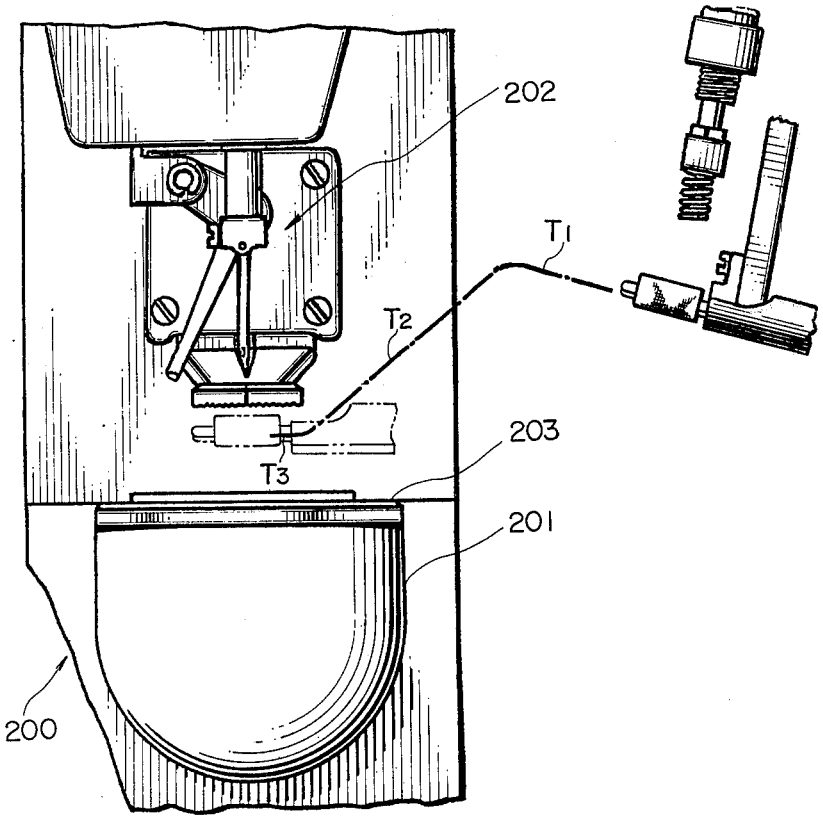
FIG. 15 is a diagram showing a path of transfer of the clamped cut piece retained by fingers.

In this embodiment, the fore plate 171 to be fixed to the holder 158 is substantially horizontal, while the rear plate 172 is slantingly held by the holder 158. As a result, a gradually upturned arrangement from the air cylinder 175 to the fingers is formed. Besides, as is shown in FIG. 10, the shape of said grooved cam is so adapted that a high horizontal portion 160*c* is formed via a portion 160*a* slightly slanting downwards and an upwardly slanting portion 160*b* from the rear side to the front side. Besides, when the fingers retreat to the utmost limit, the roller 163 comes to the position of the lower portion 160*a* of the grooved cam. Owing to these constructions, the tips of the fingers during its transfer at first goes on a linear track T1 carrying out upturned rectilinear motions as shown in FIG. 15, then goes on a curved track T2 turning to downward motions, and finally goes on a horizontal track T3 carrying out horizontal movement. These motions are important for preventing such accident that the tips of the fingers hit against the hand of the operator put near the temporary stand 201 for the garment. If the fingers are guided to the position of the imaginary line above the temporary stand 201 only by means of rectilinear motions, the fingers hit against the hand if the hand is even slightly projecting upwardly from the temporary stand 201, and it is very dangerous as the hand is caught between the temporary stand 201 and the fingers. However, if said tracks are employed, probability of the hitting accident against the hand decreases. Besides, if the fingers hit against the operator's hand, the danger is lessened as the fingers act so as to press down the hand.

As shown in FIG. 1, a scale plate 195 is fixed on the upper surface of the fore plate 171, 171 thereby enabling measurement of the location of the outer clamp means in relation to the inner clamp means. To the inside plate, namely the plate 171 located near the side of the member 111, the scale plate 195 is mounted at the prescribed position while as to the outside plate 171 the screw 196 is movable in the elongated bore 195*a*. Therefore, when the screw 196 and the screw 159 fastening the holder 158 to the shaft 157 are loosened, the outer clamp means can be slided to the direction of the inner clamp means or in the reverse direction thereby varying the interval between the fingers arranged on the right and the left respectively. The interval is represented by the pointer 197 and the indicated scale can be read out.

Only air cylinders are employed in the above embodiments, however, it is a matter of course that oil pressure cylinders or other hydraulic pressure cylinders can be used. Also, in above embodiments, single-acting type cylinders are used as those cylinders which do not require large power at the return stroke of the rod, for example the cylinder 112, 113 for fastening the material onto the receiving plates and the cylinder 175 for advancing the fingers. Of course, it is possible to employ double-acting type cylinders for these purposes. The stroke and the aperture of each cylinder can be appropriately selected according to its function and the place of the arrangement. For example, the cylinder for moving the delivery pawl to-and-fro has 100 mm of stroke and 16 mm of aperture, and the cylinder for the cutter has 25 mm of stroke and 16 mm of aperture, and the cylinder for pressing the material has 25 mm of stroke and 10 mm of aperture.

Further, multi-purpose machine having a structure capable of adjustment of the loop length is shown in above embodiments, while if a machine of exclusive use type is employed the structure thereof will be simpler as each adjustment mechanism can be stationarily formed.

A sewing machine 200 is produced by making the following improvements on the Lock Stitch Bar Tack Cylinder Bed sewing machine (hereinafter referred to as the cycle sewing machine) which is known per se.

Figure 16:
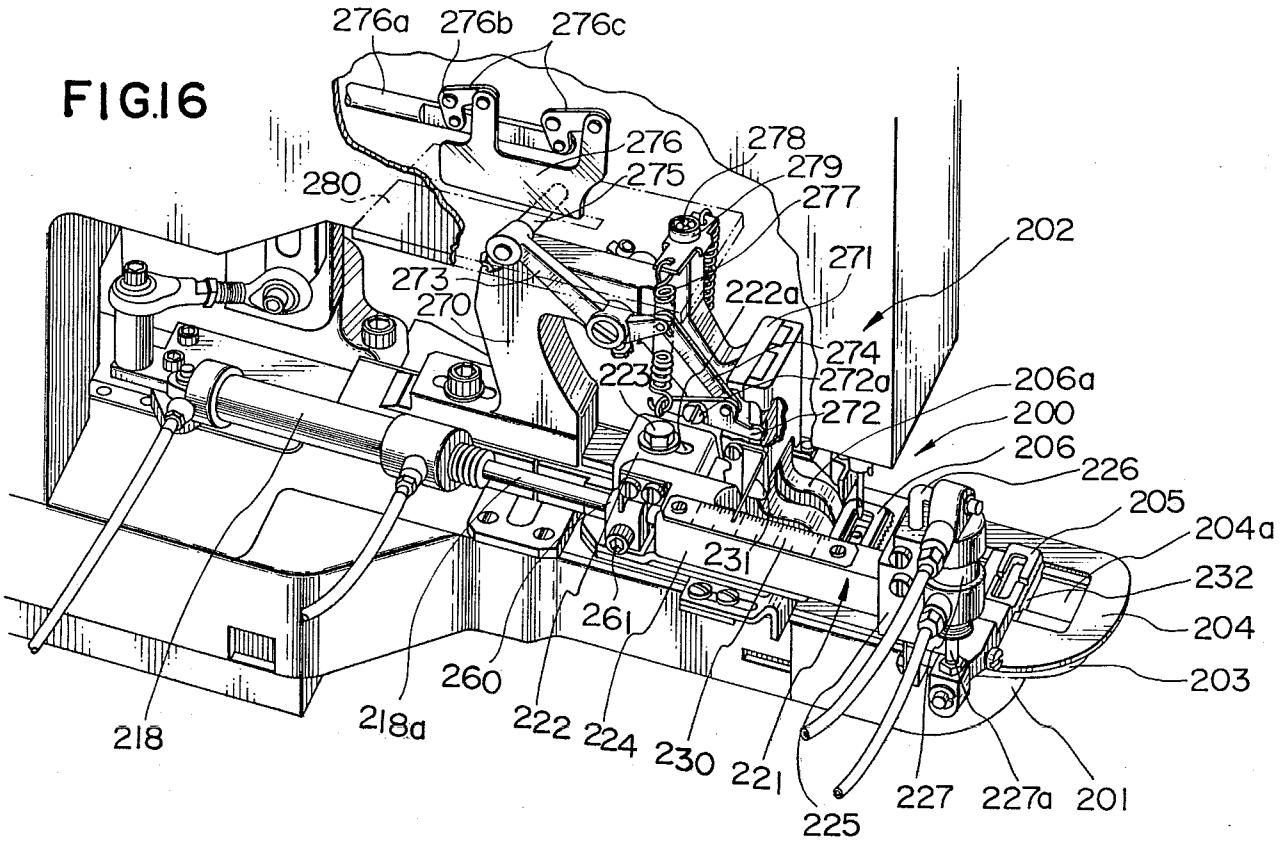
FIG. 16 is a fragmentary perspective view showing a cycle sewing machine.
Figure 16A:
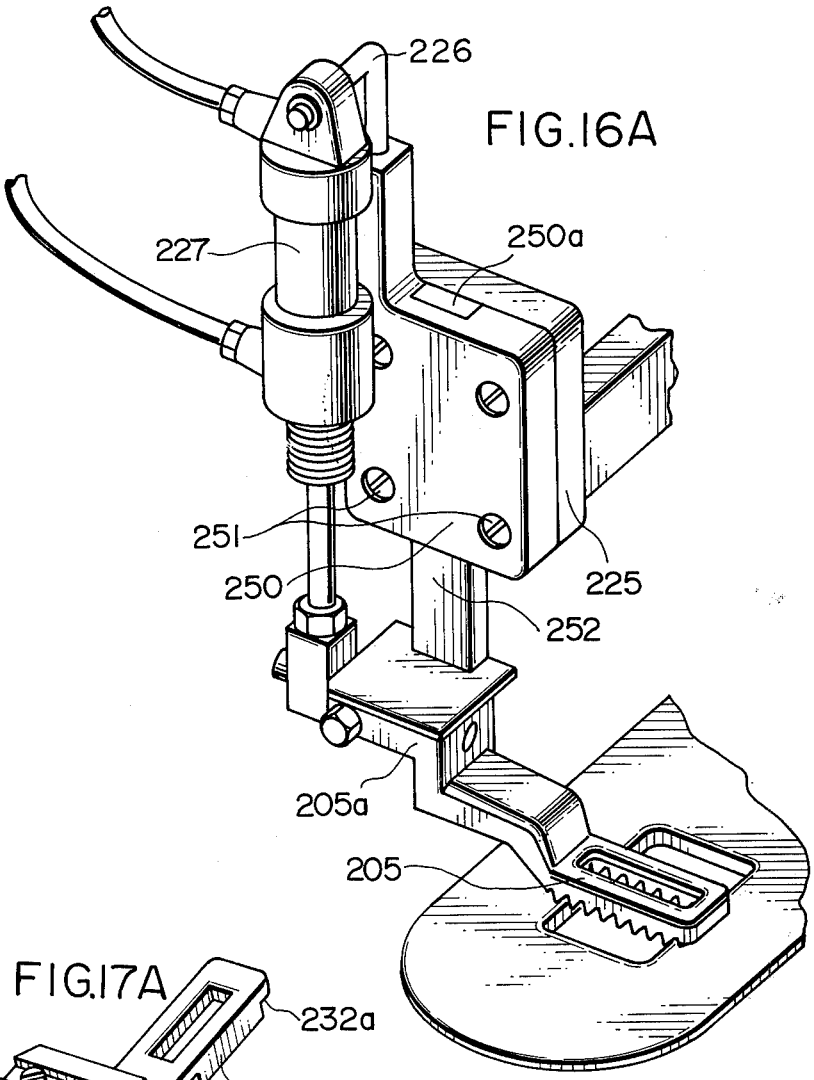
FIG. 16A is a perspective view showing a front presser foot as it is mounted in place.
Figure 17A:
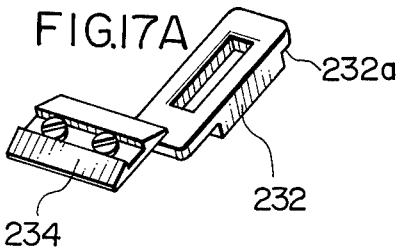
FIG. 17A is a perspective view of a movable plate.
Figure 17:
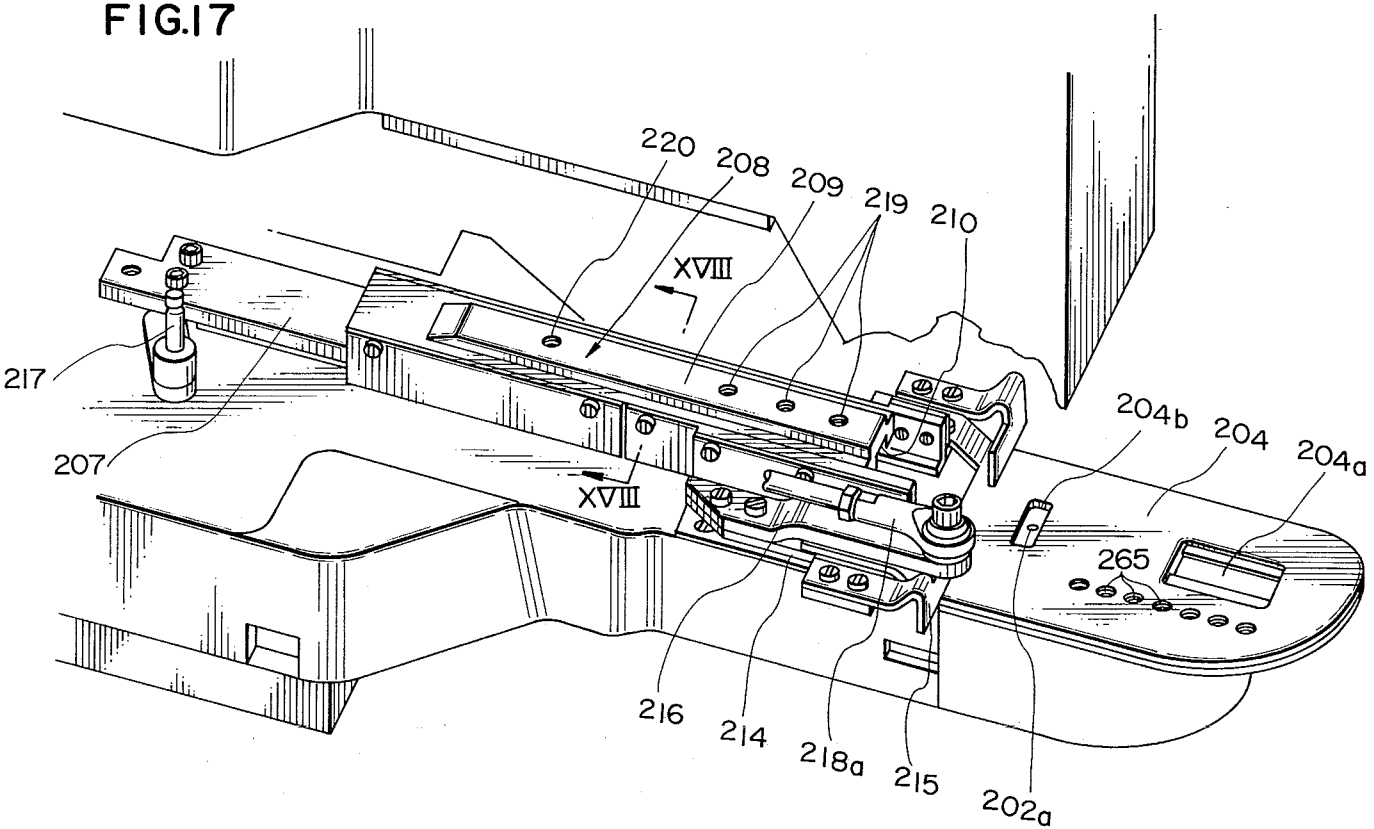
FIG. 17 is a perspective view showing a movable member of the sewing machine.
Figure 18:
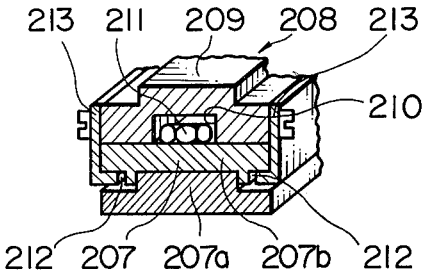
FIG. 18 is a view taken along the line 18—18 in FIG. 17.

The temporary stand 201 is a place for thrusting in the waist portions of the garment such as pants, jeans, etc. and for sewing the folded ends by the head 202. In the present invention, a presser plate 204 slidable on the upper surface of the conventionally known sewing plate 203 is mounted and a front presser foot 205 and a back presser foot 206 are formed to be movable in both vertical and to-and-fro directions. As shown in FIG. 16 – FIG. 18, a movable member 208 is slidably mounted to a pivot arm 207*a* for the cycle sewing machine through a fixed plate 207*b*. The movable member 208 has a projection 209 having a rectangular cross-section at the upper center thereof, and a groove 210 at the lower center thereof. The pivot arm 207*a* and the plate 207*b* are fastened superposedly by a bolt 211, and grooves 212, 212 are formed on the side portion thereof. On the side of said movable member 208, angle plates 213, 213 having an L-shaped cross-section are fixed by using screws. The horizontal portions at the lower ends of the angle plates 213, 213 are inserted to said grooves 212, 212 thereby arranging the movable member 208 slidable on the plate 207*b*. From the side of angle plates 213, 213 of the movable member 208, a rectangular mounting plate 214 is projecting. The plate 214 is provided with said presser plate 204, rulers 215, 215 on both sides for the adjustment of thrusting in of the garment, and an arm 216, respectively mounted thereon. A pin 217 is projecting from the rear end of the slide plate 207 consisting of the pivot arm 207*a* and the plate 207*b*. The rear end of an air cylinder 218 for driving the movable member 208 backward and forward is inserted to the pin 217. A rod 218*a* of the cylinder is inserted to the pin provided to said arm 216. On each inserted portion, a mechanism for preventing disengagement is provided. Thus, the arm 216 and the movable member 208 accordingly are driven backward and forward on the slide plate 207 by the motion of the cylinder 218. Screw bores 219, 219, 219, and 220 are provided on the projection 209 of the movable member 208 for mounting a supporting member 221 for the pressing cylinder. An elongated bore 222*a* is provided in a fixed portion 222 having a grooved lower portion for fitting with the outer shape of the projection 209. Fine adjustment is possible when the portion 222 is fixed with a bolt 223 to the screw bore 219. A portion 224 extending transversely from the fixed portion 222 also has a grooved lower portion which is covered with the rod 218*a* of the cylinder when the supporting member 221 is fastened. A supporting block 225 is extended on top of the portion 224 and a block 250 having a pin 226 as shown in FIG. 16A is fastened to the block 225 by using the screws 251, 251. A groove 250*a* is provided in the block 250, and a slide bar 252 fastened to the arm 205*a* having the presser foot 205 slides within the groove. Owing to this mechanism, the swing of the presser foot 205 is prevented and the vertical movement is securedly carried out. An air cylinder 227 which drives the presser foot vertically is suspended on said pin 226, and said arm 205*a* is fixed to the rod 227*a* of the cylinder. As a result, the presser foot 205 can be moved up and down by the air cylinder 227 and further by the air cylinder 218 backward and forward movement is possible through the movable member 208.

The presser plate 204 is provided with a large rectangular bore 204*a* at the front portion thereof and a small rectangular bore 204*b* at the rear portion thereof. The rear bore 204*b* is formed so that it comes to the position around the bore 202*a* wherein the needle goes down when the plate 204 takes the forwardly projecting position, as shown in the figure, while the front bore 204*a* is so formed that it takes the position around the needle bore 202*a* when the plate 204 is moved rearwardly. The front bore 204*a* is large-sized because variations of the thrusting length in accordance with the change of the loop length must be managed therewith.

As mentioned before, as the screw bores 219, 219 are provided in the projection 209, the fore presser foot 205 changes its position relative to the front bore 204*a* according to variations of the screw bore for the bolt 223. Thus, as the screw bore for the bolt can be suitably shosen, the change of the loop length can be managed even if the stroke of the cylinder 218 is constant. Numeral 260 designates a stopper which is to be fixed to the rod 218*a* and which can be slided on the rod 218*a* by loosening the bolt 261. The return stroke of the cylinder 218 is adjusted by this stopper. The distance from the fore presser foot 205 to the rear presser foot 206 can be known by the scale plate 230 and the pointer 231. A movable plate 232 having the same size with the fore presser foot 205 is movably and fastenably mounted on the front bore 204*a*. As is shown in FIG. 17 and FIG. 17A, screw bores 265, 265, 265 are provided in the presser plate 204 and screws are inserted into the bores on a check plate 234 integrally having the movable plate 232 and then are fastened to said screw bores. A shoulder 232*a* is provided at the lower end of the movable plate 232, being formed so that it rides on a staired portion of the bore 204*a*. Screw bores of the appropriate location are screwed so that the fore presser foot 205 corresponds to the plate 232.

As shown in FIG. 16, the rear presser foot 206 is supported by a cantilever member 270 mounted on the projection 209 and is movable forward and backward with the member 270. Thus the front and rear presser foot are simultaneously movable forward and backward by the cylinder 218. The member 270 is fixedly provided as its front end with a block 271 on which the arm 206*a* of the rear presser foot 206 is mounted vertically movably free of any deflection. The arm 206*a* is moved up or down by a lever 272. The structure of this portion is known and is the same as those usually used in cycle sewing machines. According to this invention, a bell crank 273 pivotably mounted on the member 270 has one arm connected to the lever 272 by a link 274 and the other arm carrying a rod 275. The rod 275 is positioned under a holder operating member 276 on the cycle sewing machine which member 276 is already known.

The lever 272 is pivotally movable about a pin 272*a* and is usually biased upward by a spring 277. Rolling balls 278 are positioned at the upper end of the member 270 as contained in a container 279. Some of the balls projecting above the container are in contact with the bottom of a flat portion 280 of the cycle sewing machine and roll on the flat portion when the member 270 moves, the balls further serving to stabilize the member 270. By virtue of the structure described, the lever 272 is adapted to depress the arm 206*a* usually. When the operating member 276 is moved downward by links 276*c* and 276*c* pivotable about fulcrums 276*b* by the rod 276*a*, the rod 275 is depressed, turning the bell crank, which in turn moves the lever 272 about the pin 272*a* and thereby raises the arm 206*a*. The rod 276*a* is moved by means already known in cycle sewing machines.

Figure 19:
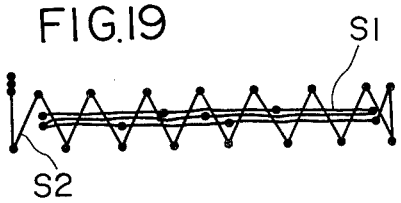
FIG. 19 is a diagram illustrating a stitch work of the sewing machine.
Figure 20:
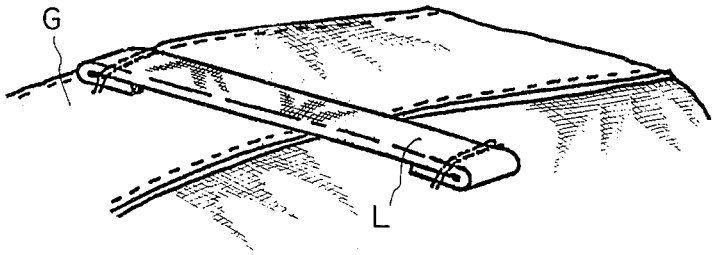
FIGS. 20 and 21 are views each showing a loop as stitched to a garment.
Figure 21:
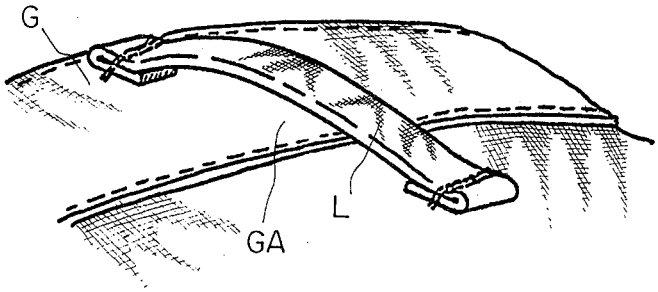

The cycle sewing machine described is adapted to form the stitch work illustrated in FIG. 19 by forming lateral stitches S1 and oblique stitches S2 to firmly stitch the loop to the garment. Stated more specifically, the loop L is stitched to the garment G as seen in FIG. 20. The loop L stitched to the garment G by the apparatus described is substantially in contact therewith. Accordingly, it will be difficult or takes some time for the user to pass a belt of great thickness through the loops. It is therefore necessary to use an apparatus by which the loop L can be attached to the garment G with a clearance GA formed therebetween. An embodiment of such apparatus will be described below.

Figure 23:
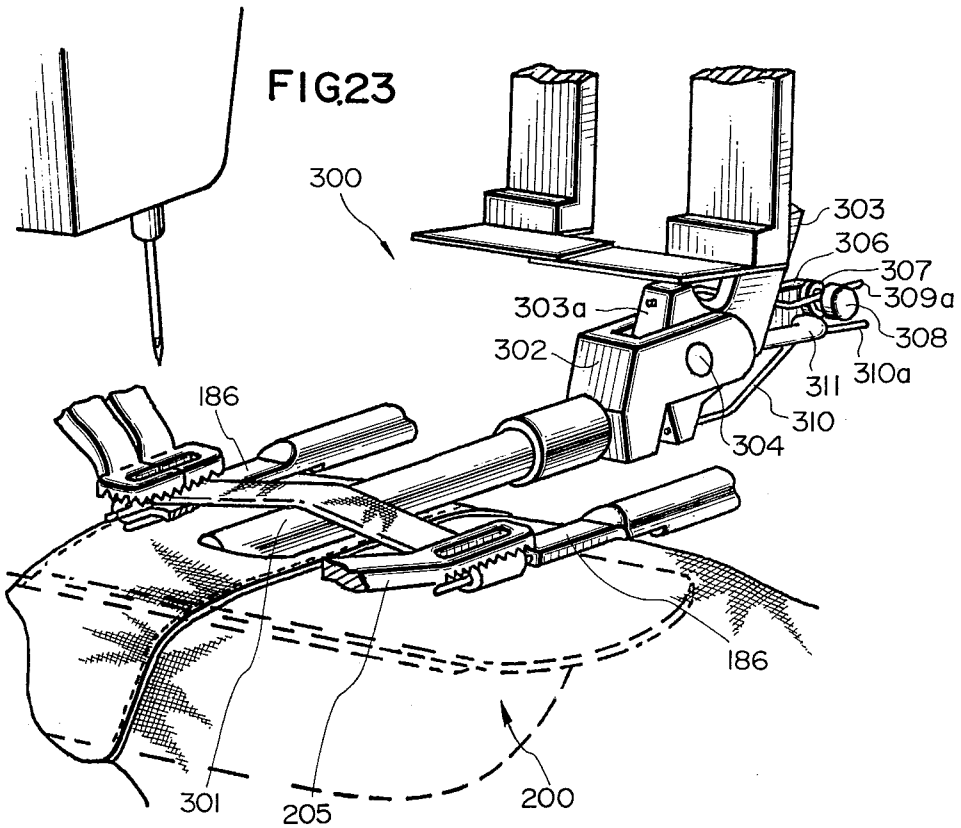
FIG. 23 is a perspective view showing the means of FIG. 22 during operation.

According to this embodiment, when the cut piece is placed onto the garment with its opposite ends folded by the two folding shafts 186, 186, a slackening rod 301 is interposed between the folded piece and the garment, whereupon the presser feet 205, 206 of the machine hold the folded ends, whereby the folded piece is loosened in accordance with the diametrical dimension of the slackening rod 301 as illustrated in FIG. 23.

Figure 22:
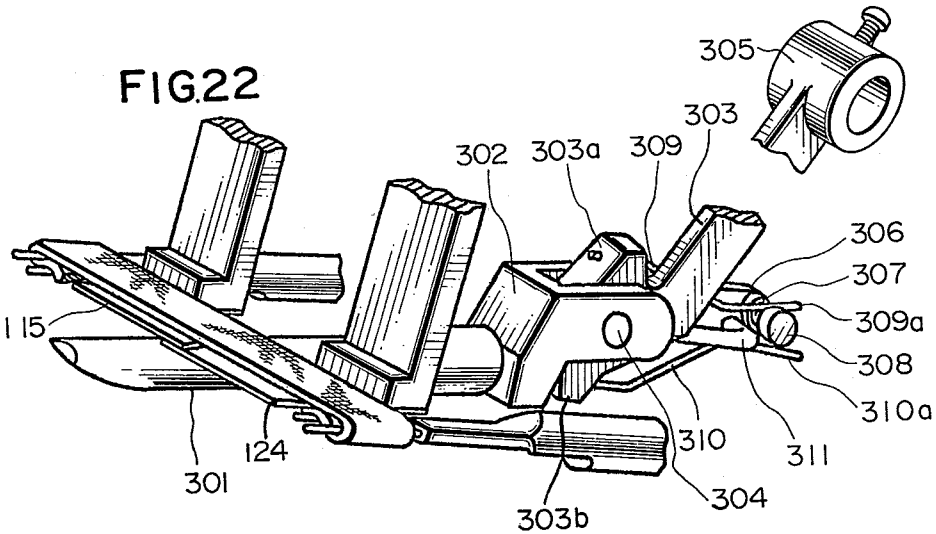
FIG. 22 is a perspective view of means for forming a slack loop.

With reference to FIG. 22, the slackening rod 301 has a front end projecting from the front ends of the receiving plates 115, 124 by about 2cm and is smoothly movable between the two folding shafts 186 in parallel thereto. The front end of the slackening rod 301 has a slanting or rounded bottom surface so as not to engage in the garment when the folded piece is transferred onto the garment. The slackening rod 301 is connected at its rear portion to a bifurcated pivotal member 302 which is mounted on a horizontal pin 304 on a support arm 303 extending obliquely downward. The member 302 is slightly pivotally movable in its substantially horizontal position. The support arm 303 carries at its upper end a holder 305 fastened to the shaft 157 by a screw. One of the bifurcated portions of the pivotal member 302 extends rightward into a portion 306. A horizontal bearing pin 308 formed with a guide groove 307 at its midportion is secured to the end of the extension 306. The support arm 303 has upper and lower projections 303*a*, 303*b*. Wire springs 309, 310 extending substantially in parallel to the slackening rod 301 are secured to the upper and lower projections 303*a*, 303*b* respectively. Toward the right ends, the wire springs 309, 310 are bent toward each other to position their right ends horizontally. The horizontal portions 309*a*, 310*a* engage in the guide groove 307 of the bearing pin 308 as if nipping the pin. Between the wire springs 309, 310, a stopper rod 311 extends along the extension 306 of the pivotal member 302 and is secured at its one end to the support arm 303. The stopper rod 311 has the same diameter as the grooved portion 307 of the bearing pin 308. The other end of the stopper rod 311 is bent to an L-shaped so that the horizontal portions 309*a*, 310*a* of the wire springs 309, 310 can bear against the rod end. The stopper rod acts to prevent repeated vibration of the wire springs 309, 310. Usually, the slackening rod 301 is positioned substantially at the same level as the two folding shafts 186. While the folding bars 186 are in their returned position on the right side of the machine 200, the slackening rod 301 is held in contact with the bottom of the receiving plates as lowered by an amount corresponding to the radius of the rod 301. In this position the slackening rod is under the action of the wire spring 309.

The slackening means 300 of the foregoing structure operates in the following manner. The slackening rod 301, when released from the receiving plates, rises under the action of the wire spring 309 to substantially the same level as the folding shafts 186, namely by an amount corresponding to the radius of the rod 301, thereby lifting the midportion of the folded piece. This draws the piece itself outward at the folded opposite end portions by an amount corresponding to the amount of rise of the slackening rod 301, i.e. to the radius of the rod.

Figure 24:
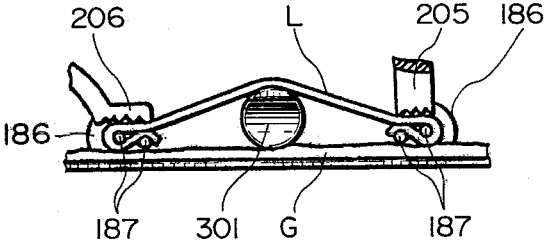
FIG. 24 is a diagram showing the slack loop while it is being formed.

On the completion of the transfer of the folded piece onto the garment, the front and rear presser feet 205, 206 on the machine 200 descend at the same time, holding the opposite end portions of the piece with these portions retained in the folded state by the fingers attached to the folding bars 186 as shown in FIG. 23. During this operation, the slackening rod 301 is depressed into contact with the garment G with the lowering of the loop L and held between the loop L and the garment G as seen in FIG. 24. At the same time, the downward movement of the front and rear presser feet 205 and 206 draws out the loop itself at its folded opposite end portions by an amount corresponding to the amount of the downward movement in accordance with the radial dimension of the rod 301. When the loop is held at its opposite ends by the presser feet, the slackening rod is retracted along with the folding bars 186. The loop in its slack state is then stitched to the garment by the machine.

Although the description of the apparatus given above mentions nothing about the switches for effecting a series of sequential operations in response to electric signals, the arrangement of the switches and the sequential operations will be obvious to one skilled in the art. For instance, various cylinders can be sequentially operated with the use of limit switches which detect the extremity of the forward or backward stroke of the cylinder rod, or the limit switch may be adapted to detect only the extremity of the forward stroke, whereupon a timer may be actuated for the retraction of the cylinder rod, or alternatively, upon detecting that some other member has completed its operation, the cylinder rod can be initiated into retraction.

With the apparatus adapted for varying loop lengths, the adjustable portions are adjusted to the desired loop length before operation. More specifically, the knob 64 on the delivery means 50 is loosened to adjust the position of the stopper 61 and determine the length of retraction of the delivery pawl 53. In conformity with this length, the support plate 123 of the fastening means 110 is shifted relative to the member 111*a* for adjustment. The fore plate 171 and the holder 158 for the outer clamp means 170 are set in position. The front presser foot 205 on the cycle sewing machine 200 is further set in position.

An elongated material M prepared in the form of a strip in advance is inserted into one end of the trough 52 included in the delivery means 50. The leading end of the material is led to the outlet end of the trough 52 by hand. The apparatus is then initiated into automatic operation. In response to the signal sent out on depression of a start button (not shown), the air cylinder 55 starts to operate, causing the delivery pawl 53 to feed the material. When the material is sent out by a specified length by the stroke of the cylinder 55, the middle portion of the length of the material is placed on the receiving plates 115, 124 of the fastening means 110, with its forward end projecting outward from the receiving plate 124. When the material has been completely sent out, the cylinders 112, 113 on the fastening means 110 operate, lowering the blocks 116, 124 and causing the arm 122 on the block 124 to press the material against the vertical wall 124*b* of the receiving plate. At the same time, the springs 117, 121 on the bottom of the blocks fixedly hold the material in place. The material is now positioned approximately midway between the upper and lower fingers located close to the receiving plates as illustrated in FIG. 13. After the material has been fixed in place, the air cylinders 175 for the pair of clamp means included in the transfer means 150 are actuated, advancing the fingers 187 toward the opposite ends of the length of the material, with the result that the material is placed between the upper and lower fingers. The air cylinder 78 is then operated to turn the cutter 67 to cut the material. While the cutter 67 is in its lowered position, the delivery pawl 53 starts to return while sliding on the material which is pressed on by the plate spring 69*a*. The return of the delivery pawl 53 is limited by the stopper 61.

After the cutting of the material, the air cylinders 184 are operated to move the racks 185, which in turn rotate the pinions 179. The shafts 186 therefore rotate, turning the fingers 187 to such an extent that the upper fingers are brought approximately to the same level as the lower fingers as shown in FIG. 14. Consequently, the pairs of the fingers fold the opposite ends of the cut piece and, at the same time, the cut piece is clamped by the fingers as indicated in solid lines in FIG. 13.

Figure 25:
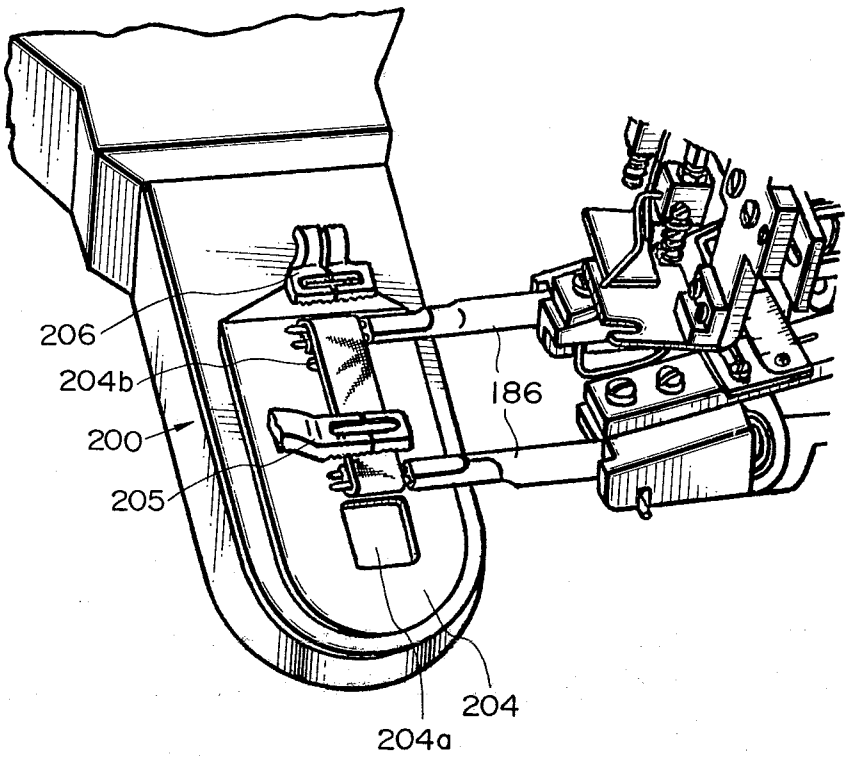
FIG. 25 is a perspective view showing the clamped cut piece as brought to a position above the sewing machine.

The air cylinders 112, 113 of the fastening means 110 are then deactivated. In response to a signal emitted from the foot switch on the sewing machine, the air cylinder 151 on the transfer means 150 is actuated, moving the movable bracket 152 and simultaneously bring both the clamp means 170 into transfer operation, whereby the folded piece is moved away from the receiving plates toward the cycle sewing machine. For the transfer operation, the fingers move along a path indicated by a lines T1 to T3 in FIG. 15 and reach the cycle sewing machine 200. The folded piece brought to above the cycle sewing machine 200 is so positioned that the fingers on the opposite ends thereof are located below the front and rear presser feet 205, 206. In this state, the fingers at one end are positioned below the front presser foot 205 and above the front opening 204*a* formed in the presser plate 204, and the fingers at the other end are positioned below the rear presser foot 206 and above the rear opening 204*b* formed in the presser plate. Before the transfer of the folded piece onto the cycle sewing machine 200, the body portion of a garment is fitted over the support 201 on the machine. The foot switch emits a signal as already stated. Upon the placement of the folded cut piece in the specified position on the cycle sewing machine as seen in FIG. 25, the front and rear presser feet 205, 206 descend, pressing the opposite ends of the folded piece against the presser plate 204 and bringing the folded piece into contact with the garment. At this time, the fingers pivotally move about the support points 176 of the air cylinders 175. With the folded piece held in position by the presser feet 205, 206, the rod 151*a* starts to retract under high pneumatic pressure now acting in the reverse direction within the air cylinder 151 of the transfer means. This movement backwardly withdraws the fingers from the folded opposite ends of the cut piece. On the completion of the retraction of the transfer means, the air cylinders 175 of the clamp means are deactivated, permitting the fingers to return to the rear of the receiving plates. High-pressure air acts in the reverse direction within the cylinders 184 and moves the racks 185, which turn the fingers. The parts are now ready for the next cycle of transfer operation. While the transferred cut piece is being stitched to the garment, the material is automatically sent out. Following the same procedure as above, a new cut piece is retained on the receiving plates with its opposite end clamped by the fingers.

When the transfer means has been retracted approximately to the middle of its travel, a signal is fed to the sewing machine, initiating the following operation. With the rear presser foot 206 located at the position of the needle of the cycle sewing machine, the needle starts to stitch the rear end of the cut piece in the same manner as in conventional cycle machines. When the rear end has been completely stitched to the garment, the front and rear presser feet are shifted backward by the air cylinder 218, with the cut piece and garment held between the foots and the presser plate 204, whereby the front presser foot 205 is brought to the position of the needle. The front end is then stitched in place, and the loop is now completely fixed to the garment. The presser plate 204 and the front and rear presser foots 205, 206 thereafter advance. The foots are raised. The parts are now ready for the next stitching cycle.

The slackening means 300, when used, is installed in place, and the operation is carried out exactly in the same manner as above.

If the material includes a seam, the seamed portion is detected by the detector 80, then cut off and removed automatically.

What is claimed is:

1. An apparatus for forming loops on a garment comprising:

delivery means for sending out an elongated material, said delivery means being provided with means for detecting a seam portion and means for removing a cut piece including a seam portion in response to a signal from the detecting means, means for fastening the sent out material on at least one receiving plate, two clamp means provided on the opposite sides of the receiving plate respectively for clamping the fastened material at its opposite ends, a cutter for cutting the fastened material, a cycle sewing machine, and transfer means for simultaneously moving the two clamp means toward and away from the cycle sewing machine, each of the clamp means having two fingers for folding an end portion of the material in nipping engagement therewith and clamping the same, the cycle sewing machine having a front presser foot, a rear presser foot and a cloth retaining presser plate formed with openings opposed to the presser feet respectively, the presser feet and the presser plate being movable, whereby after one folded end portion of a cut piece of the material is stitched to the garment, the presser feet and the presser plate are moved with the cut piece and the garment held therebetween to bring the other folded end portion of the cut piece to a stitching position and thereafter stitch the end portion to the garment.

2. An apparatus as defined in claim 1 further comprising means for forming slack loops.

3. An apparatus as defined in claim 2 which is adjustable for varying loop lengths.

4. An apparatus as defined in claim 2 wherein the fingers on the clamp means are pivotally movable about one point, the clamp means being disposed in an oblique position to position the forward ends of the fingers at the highest level, the clamp means being in engagement with a grooved cam to permit the fingers to travel to the cycle sewing machine along a path including straight and curved tracks.

5. An apparatus as defined in claim 3 wherein the fingers on the clamp means are pivotally movable about one point, the clamp means being disposed in an oblique position to position the forward ends of the fingers at the highest level, the clamp means being in engagement with a grooved cam to permit the fingers to travel to the cycle sewing machine along a path including straight and curved tracks.

6. An apparatus as defined in claim 4 wherein the delivery means includes a channel-shaped trough and a delivery pawl, and the fastening means includes means for pressing a hem of the material against a vertical wall of the receiving plate and a spring for pressing the material.

7. An apparatus as defined in claim 5 wherein the delivery means includes a channel-shaped trough and a delivery pawl, and the fastening means includes means for pressing a hem of material against a vertical wall of the receiving plate and a spring for pressing the material.

8. An apparatus for forming loops on a garment comprising:

delivery means for sending out an elongated material, means for fastening the sent out material on at least one receiving plate, two clamp means provided on the opposite sides of the receiving plate respectively for clamping the fastened material at its opposite ends, a cutter for cutting the fastened material, a cycle sewing machine, and transfer means for simultaneously moving the two clamp means toward and away from the cycle sewing machine, said transfer means comprising a movable bracket having two holders, each of the clamp means comprising a substantially E-shaped coupling block, a shaft having at one end thereof two fingers for folding an end portion of the material in nipping engagement therewith and clamping the same and at the other end thereof a pinion for engagement with a rack movably mounted on the coupling block, and a cylinder pivotally mounted on the holder for moving the shaft axially, the coupling block mounting in one portion thereof the shaft rotatably and securing in the other portion thereof a rod protruding from the cylinder, the shaft being biased by at least one spring, the cycle sewing machine having a front presser foot, a rear presser foot and a cloth retaining presser plate formed with openings opposed to the presser feet respectively, the presser feet and the presser plate being movable, whereby after one folded end portion of a cut piece of the material is stitched to the garment, the presser feet and the presser plate are moved with the cut piece and the garment held therebetween to bring the other folded end portion of the cut piece to a stitching position and thereafter stitch the end portion to the garment.

9. An apparatus as defined in claim 8 wherein the fastening means comprising a supporting plate, two cylinders and an arm for pressing a side of the material, the supporting plate being provided with the receiving plate at its lower portion, the arm being mounted on a rod protruding from the cylinder which is disposed to the faraway position from the cutter, and the rod being rectangular in section.

10. An apparatus as defined in claim 9 wherein the fastening means having two receiving plates, the cylinder with the arm being movable, and the receiving plate for the movable cylinder having a cutout portion.

* * * * *